United States Patent [19]

Gorog et al.

[11] 4,402,798

[45] Sep. 6, 1983

[54] METHOD FOR THE MANUFACTURE OF A METALLIC RECORDING SUBSTRATE FOR A CAPACITANCE ELECTRONIC DISC AND THE RECORDING SUBSTRATE OBTAINED THEREBY

[75] Inventors: Istvan Gorog, Princeton; Leonard P. Fox, Cherry Hill, both of N.J.

[73] Assignee: RCA Corporation, New York, N.Y.

[21] Appl. No.: 348,677

[22] Filed: Feb. 16, 1982

[51] Int. Cl.[3] ..... C25D 1/10; C25D 1/20

[52] U.S. Cl. ..... 204/5; 204/281

[58] Field of Search ..... 204/5, 281

[56] References Cited

U.S. PATENT DOCUMENTS

| | | | |
|---|---|---|---|
| 2,067,502 | 1/1937 | Pollard | 204/5 |
| 3,904,488 | 9/1975 | Nosker | 204/5 |
| 4,044,379 | 8/1977 | Halter | 358/128 |
| 4,060,831 | 11/1977 | Halter | 358/128 |
| 4,088,544 | 5/1978 | Hutkin | 204/281 |
| 4,262,875 | 4/1981 | Nyman et al. | 249/114 R |

OTHER PUBLICATIONS

J. K. Clemens, "Capacitive Pickup and the Buried Subcarrier Encoding System for the RCA VideoDisc", pp. 33–59, RCA Review, vol. 39, Mar. 1978.

E. O. Keizer, "VideoDisc Mastering", pp. 60–86, RCA Review, vol. 39, Mar. 1978.

I. Gorog, "Optical Techniques Developed for the RCA VideoDisc", pp. 162–185, RCA Review, vol. 39, Mar. 1978.

*Primary Examiner*—T. M. Tufariello

*Attorney, Agent, or Firm*—Birgit E. Morris; Edward J. Sites

[57] ABSTRACT

In accordance with the present disclosure recorded metallic recording substrates made of a relatively soft metal are coated with a conformal 200 to 400 angstroms thick layer of chromium, chromium oxide, or a mixture thereof, and then preferably passivated prior to being used as matrixes in the replication process.

11 Claims, 5 Drawing Figures

METHOD FOR THE MANUFACTURE OF A METALLIC RECORDING SUBSTRATE FOR A CAPACITANCE ELECTRONIC DISC AND THE RECORDING SUBSTRATE OBTAINED THEREBY

This invention relates to a method for the production of metallic recording substrates for use in the manufacture of capacitance electronic discs and, more particularly, is concerned with a method to reduce carrier-to-noise ratio losses and the occurrence of microdefects in the replication process.

BACKGROUND OF THE INVENTION

Capacitance electronic discs have been developed which when played back on the appropriate player will produce signal information similar to a conventional television broadcast signal. If the signal information produced on playback of a capacitance electronic disc is supplied to a conventional home television receiver, the programming recorded on the disc can be reproduced on the television receiver.

In the capacitance electronic disc system the video and audio signal information is pressed into a plastic disc in the form of surface relief variations in the information track of the disc. During playback of the plastic disc a capacitive electronic pickup system converts the surface relief variations into electrical signals as described by J. K. Clemens in "CAPACITIVE PICKUP AND THE BURIED SUBCARRIER ENCODING SYSTEM FOR THE RCA VIDEO DISC", RCA Review 39, P. 33, March 1973, which is incorporated by reference into this specification.

The carrier-to-noise ratio of the video and audio signals obtained on playback of the capacitance electronic disc to a large extent define the limits of the quality of playback of the disc. In general, the higher the carrier-to-noise ratio, the higher will be the quality of the reproduction of the recorded programming. While precise lower limits for carrier-to-noise ratios cannot be given as there is a gradual corresponding decrease in signal quality with a decrease in the carrier-to-noise ratios, it appears that for commercially acceptable playback on a conventional television receiver, the video signal carrier-to-noise ratio should be above about 50 dB and the audio carrier-to-noise ratio should be above about 25 dB.

The losses in the carrier-to-noise ratio of the recording as compared to the original programming occurs at various stages in the manufacture of capacitance electronic discs, such as, in the recording of the signal information in the recording substrate, the replication of the recording substrates to make masters, the manufacture of the molds and stampers, and the molding of the plastic capacitance electronic discs.

One area where considerable problems have been encountered with regard to losses in the carrier-to-noise ratios is in the replication of the recorded substrate to produce masters. The recording of the programming information for a capacitance electronic disc is made in a metal recording substrate. The recording for the capacitance electronic discs must be made in metal substrates, as opposed to lacquer substrates used for conventional stereo audio records, because of the extremely small size of the video and audio signal elements and the extreme accuracy of recording required for capacitance electronic discs. The information track containing the signal information is cut in a layer of a relatively soft metal, such as electrodeposited bright acid copper. The surface of the recorded metal substrate is then passivated and masters are electroformed and removed from the recorded surface of the recording substrates.

A problem which has been encountered with the metallic recording substrates, and in particular with copper recording substrates, is that there can be a substantial decrease in the carrier-to-noise ratio for both the video and audio signals as a result of masters being formed on and removed from the recording substrate. This reduction in the carrier-to-noise ratio is the most critical factor which determines the useful life of a recording substrate. A further, and even more serious, problem is that some metallic substrates, and in particular copper substrates prepared as noted above, often exhibit a very substantial drop in the carrier-to-noise ratios after only a few masters are formed on the substrate. This unexplained phenomenon is difficult to explain in that it is not encountered with all substrates and some of the substrates that are affected will recover most of the lost carrier-to-noise ratio after a few unsatisfactory masters are made on the substrate.

Another serious problem that is encountered with the prior art recording substrates is that microdefects often develop in the recorded area of masters formed on the substrates. The term microdefect as used herein refers to defects such as bumps or pits which appear in the recorded area of the masters, molds and stampers. The microdefects are relatively small, from about 5 to 20 micrometers or slightly larger. However, because of the narrow width of the information tracks and the small size of the signal elements, the microdefects can extend over a number of information tracks and can cause a problem which is referred to as "lock groove" in which the same information track will be repeatedly played on playback, or "skip groove" wherein a number of information tracks will simply be passed over during playback of the video disc.

What would be highly advantageous would be an improvement in the method for the manufacture of metallic recording substrates for capacitance electronic discs which would reduce losses in the carrier-to-noise ratios which occur during replication and which would reduce the number of microdefects in resulting masters.

SUMMARY OF THE INVENTION

In accordance with the present invention recorded metallic recording substrates made of a relatively soft metal are coated with a conformal 200 to 400 angstroms thick layer of chromium, chromium oxide, or a mixture thereof, and then preferably passivated prior to being used as matrixes in the replication process.

DETAILED DESCRIPTION OF THE INVENTION

Figure 1:
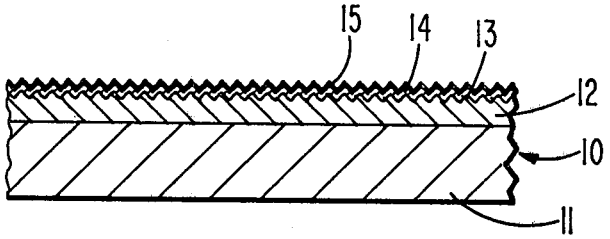
FIG. 1 is a cross-sectional illustration of a section of a metallic recording substrate manufactured in accordance with the teachings of this invention.

A portion of the preferred recording substrate of this invention 10 is illustrated in cross-section in FIG. 1. The substrate 10 consists of a support base 11, a layer of a relatively soft metal 12 into which an information track 13 is cut, a conformal layer 14 of chromium, chromium oxide, or a mixture thereof, and an optional passivated surface 15 formed on the conformal layer 14.

The initial step in the preparation of the recording substrate of the invention 10 is to form a blank recording substrate. The information track 13 for a capacitance electronic disc must be cut into a metal substrate in order to obtain the required accuracy in recording the video and audio signals. The metal into which the recording is made should be relatively soft so that the information track 13 can readily be cut into the metal during the recording process, but must also be sufficiently hard so it will not easily be distorted in subsequent processing steps. Various metals can be used for this purpose, such as silver and certain gold alloys, with electrodeposited bright acid copper being the preferred metal based on cost and performance.

The layer of the metal 12 into which the information track 13 is recorded can be relatively thin. The information track 13 is typically at most about 4,500 angstroms in depth so that a layer 12 which is about 10,000 angstroms thick is quite adequate for recording purposes. The layer of metal 12, however, must be supported in a flat configuration for recording and for replication. While it is possible to make a relatively thick recording substrate of the metal into which the recording is to be made, it is been found to be more feasible from a cost and weight standpoint to electroform the metal layer 12 onto a support 11, preferably a flat disc of highly polished tempered aluminum about 1 centimeter in thickness.

The metal layer 12 is electrodeposited on the surface of the support base 11 using conventional well-known disposition techniques. The surface of the metal layer 12 is then micromachined to provide a smooth, flat, virgin surface for recording of the information track 13.

The information track 13 is then cut into the metal layer 12 with a diamond cutter. The techniques and apparatus suitable for making the recording are disclosed by E. O. Keizer, "VIDEO DISC MASTERING", RCA Review, Vol. 39, No. 1, at pages 78–84 (March 1978).

The fidelity of the recording made in the metal layer 12 to the original from which the recording is made can be evaluated by reading the signal information in the information track 13. The recorded substrate should be evaluated to determine if the carrier-to-noise ratio is above the minimum levels required for satisfactory playback. A convenient and well-recognized method to evaluate the signal carrier-to-noise ratio obtained is to record a single frequency signal and measure the ratio of the recorded signal power to the noise power in a 30 Khz bandwidth. The measured signal-to-noise ratio is commonly referred to as signal carrier-to-noise ratio.

If the signal information of the required quality has been recorded in the metal layer 12, the surface of the layer 12 is then carefully cleaned to remove any metal particles and other surface contaminates.

A conformal layer 14 of chromium, chromium oxide, or a mixture thereof is then formed on the recorded surface of the metal layer 12. The method employed to form the layer 14 of chromium, chromium oxide, or the mixtures thereof on the recorded metal layer 12 can be, for example, chemical vapor deposition, vacuum deposition, and most preferably sputter deposition. Conventional electroplating methods are not suitable for use in the method of this invention in that metal must be electroplated in a relatively thick layer in order for a continuous layer to be deposited and at the required thickness the electrodeposited metal tends to fill up the information tracks so as to obliterate the recorded signal information.

In view of the preferability of sputter deposition with regard to the quality of the layer 14 formed on the metal layer 12, specific attention will be directed to this technique in order to further illustrate this invention. When applying the conformal layer by sputtering, the recorded substrate is placed into a sputtering chamber of conventional design, and a conformal layer of chromium, chromium oxide, or a mixture thereof is sputter coated onto the recorded surface. Chromium, chromium oxide, and mixtures of chromium and chromium oxide appear to be approximately equivalent for use in this invention, in that when chromium is applied, at least the outer surface of the conformal coating will be converted to a chromium oxide on exposure to air.

Certain other metals closely related to chromium, when sputter coated onto the recorded surface of the substrate, not only do not impart the desired improvement to the recording substrate, but may accentuate carrier-to-noise ratio losses and tend to promote additional microdefects in the masters formed on the treated substrates. Nickel, for example, has been found specifically to be related to a reduction in the carrier-to-noise ratio after a certain number of replications have been formed on the matrixes treated with nickel. Furthermore, nickel also appears to have the effect of increasing the number of microdefects in the masters formed on the recorded substrates.

The chromium, chromium oxide, or a mixture of chromium and chromium oxide is formed in a layer 14 which is conformal with respect to the information track 13 cut into the recorded surface of the metal layer 12 and which has a thickness between 200 and about 400 angstroms. A minimum thickness of about 200 angstroms is required in order to ensure that the entire surface of the recorded area of the metal layer 12 is covered with a substantially pin-hole free layer. The upper limit of about 400 angstroms is also important in that thicker layers tend to form nonconformally and fill in the recorded signal elements.

It is possible to use the recording substrate having the conformal surface layer 14 of chromium, chromium oxide, or a mixture thereof without further treatment as a matrix for making masters, as both chromium and chromium oxide are inherently passive in the electroforming process.

It has been found, however, that it is highly preferable to passivate the surface of the conformal layer 14 prior to using the recording substrate 10 as a matrix in an electroforming process. The passivation is preferably performed in that because of the relative thinness of the layer 14 of chromium, chromium oxide, or mixture thereof applied to the substrate, the resulting conformal layer 14 may contain small pin holes, connecting pores, and small discontinuities which can extend through to the underlying metal layer 12. If the conformal layer 14 is porous and is not passivated, the metal electrodeposited in the subsequent matrixing process may adhere to the underlying metal layer 12 and cause defects in the resulting masters. The passivated surface 15 is obtained using conventional well-known techniques. The surface can be passivated, for example, by using potassium dichromate or other similar materials to inactivate the surface with regard to the metals to be applied in subsequent matrixing steps.

The recording substrate of this invention is used in much the same manner as conventional prior art recording substrates. In subsequent replication steps the metal used to form the master is electroplated onto the recording substrate 10 and the electroformed master is then removed from the recording substrate 10. In the preferred method of practicing this invention, the recording substrate 10 is repassivated after each replication.

The recording substrate 10 should likewise be evaluated after each master is removed from the recording substrate to determine if the recording substrate still exhibits a satisfactory carrier-to-noise ratio for use in the matrixing process.

It has been found that the conformal layer 14 of chromium, chromium oxide, or mixture imparts certain highly desirable and unexpected properties to the recording substrate 10. The conformal layer 14 substantially reduces losses in the carrier-to-noise ratios which typically occur as a result of replication of masters on the recording substrate 10. An even further surprising result which is obtained is that significantly fewer microdefects are formed in the masters made on the recording substrate of this invention 10 as compared with untreated recording substrates such as copper substrates.

The following examples are given by way of further illustration of this invention and are not intended to limit the scope of the claims beyond that of the subjoined claims.

EXAMPLE 1

A recording substrate blank was formed by electrodepositing bright acid copper on a prepared aluminum support. The surface of the blank was micromachined to provide a bright, smooth, virgin copper surface.

Figure 2:
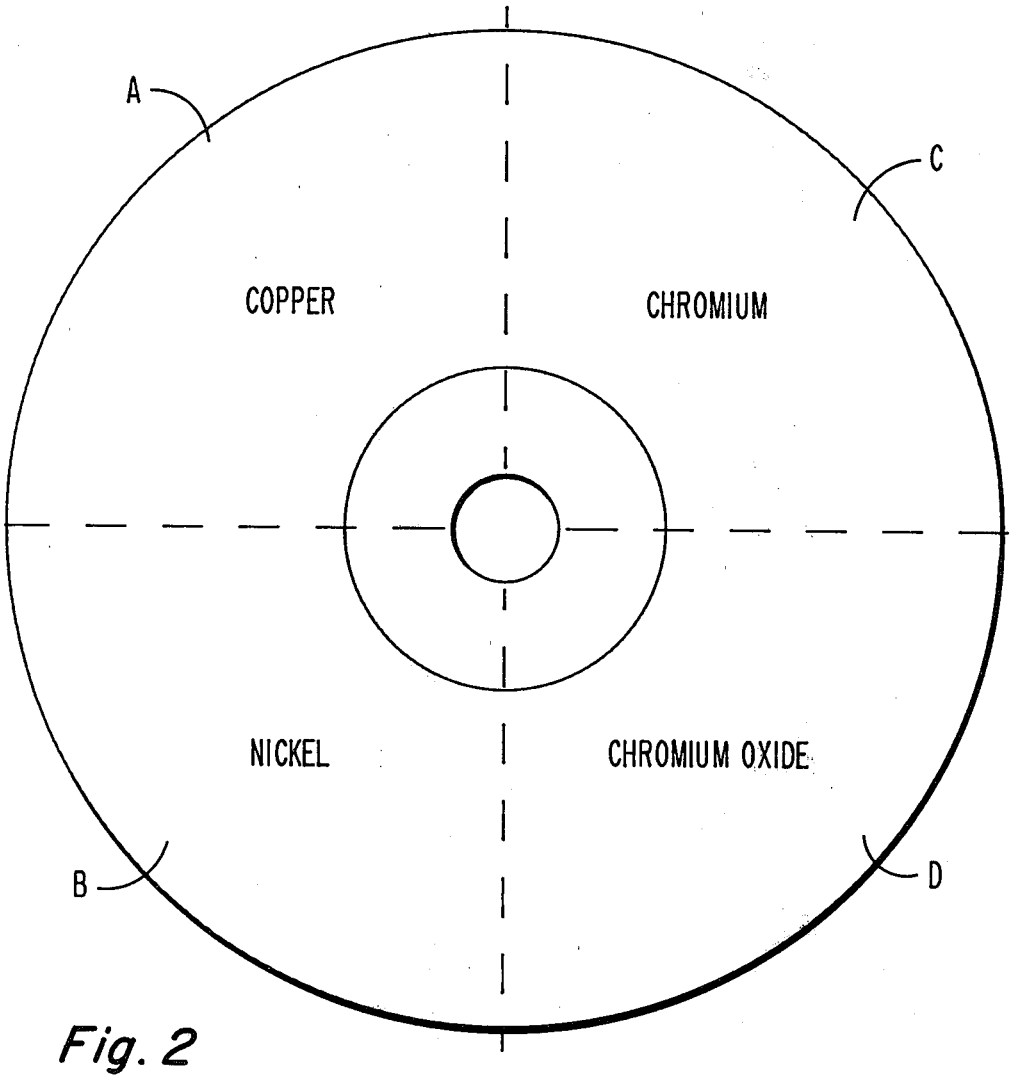
FIG. 2 is a top-plane illustration of an experimental recording substrate prepared with a different exposed metal surface in each of the quadrants thereof.

A standard test signal pattern, containing both an about 0.7 MHz frequency audio signal and a 5 MHz frequency video signal, was cut in the form of a spiral information track into the recording blank. As the spiral information track was being cut into the recording substrate, the surface topography corresponding to the recorded information was read with a focused laser beam and the signal carrier-to-noise ratio was measured. The total depth of the information track, as well as the depth of the individual video track and audio track, was measured using laser diffraction methods. For future test purposes the recording substrate was divided into four zones or test quadrants as indicated by the drawing in FIG. 2. The test results obtained on the recorded substrate without further treatment are listed in the chart below.

| | A | B | C | D |
|---|---|---|---|---|
| Audio signal carrier-to-noise ratio (dB) | 38–42 | 38–42 | 38–42 | 38–42 |
| Video signal carrier-to-noise ratio (dB) | 58–61 | 58–61 | 58–61 | 58–61 |

-continued

| | A | B | C | D |
|---|---|---|---|---|
| Depth audio signals (Å) | 98 | 99 | 100 | 99 |
| Depth video signals (Å) | 946 | 944 | 947 | 940 |
| Information track depth (Å) | 4353 | 4366 | 4377 | 4372 |

The measurement of the four quadrants as recorded above indicates that all four were equivalent as measurements were clearly within the experimental error range.

The recorded substrate was then masked so that only one quadrant at a time remained exposed. One of the quadrants (A) was left untreated, that is, was left with the copper surface as formed. The second quadrant (B) was thereafter sputtered to provide a conformal layer of approximately 200 angstroms thick of nickel on the surface thereof. The third quadrant (C) was sputtered with about a 200 angstroms thick layer of chromium. The fourth quadrant (D) was sputter coated with about 200 angstroms of chromium oxide by reactive sputtering chromium through oxygen onto the surface of the recording substrate.

The carrier-to-noise ratios and the depth of the information tracks in each of the quadrants (A, B, C, D) were remeasured and the results were found as follows:

| | Copper (A) | Nickel (B) | Chromium (C) | Chromium Oxide (D) |
|---|---|---|---|---|
| Audio signal carrier-to-noise ratio | 42 | 42 | 43 | 43 |
| Video signal carrier-to-noise ratio | 56 | 52 | 55 | 55 |
| Depth audio signal (Å) | 118 | 103 | 101 | 102 |
| Depth video signal (Å) | 945 | 889 | 914 | 907 |
| Information track depth (Å) | 4339 | 4304 | 4376 | 4397 |

The results obtained, as noted above, showed that the nickel, chromium and chromium oxide, were applied as conformal layers and did not adversely affect the carrier-to-noise ratios.

Figure 3:
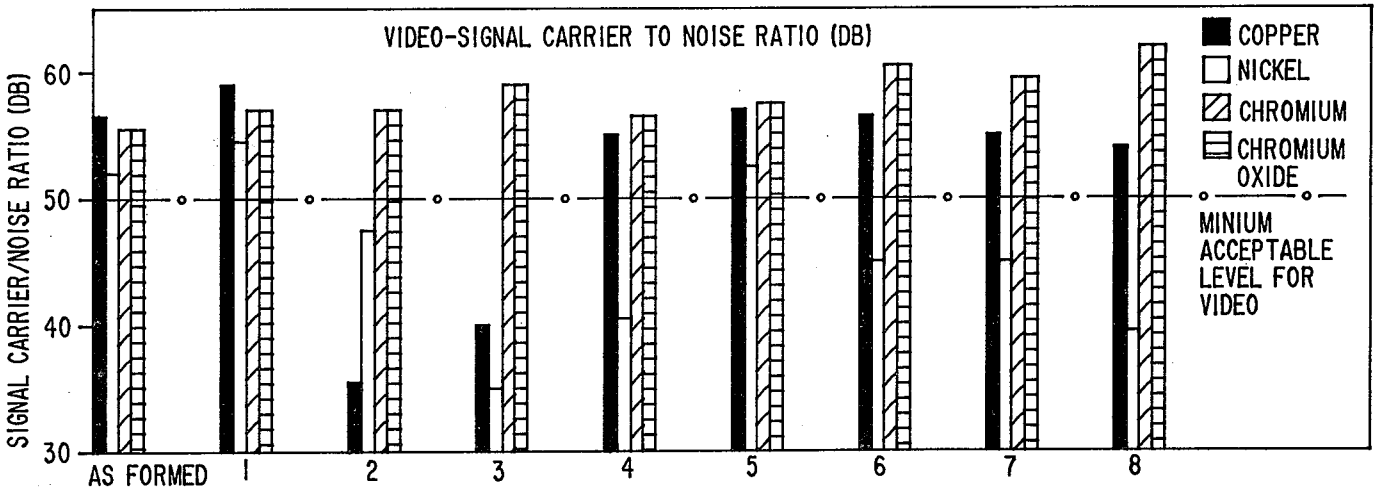
FIG. 3 is a graphic illustration of the video signal carrier-to-noise ratios in each of the quadrants of the experimental recording substrate.
Figure 4:
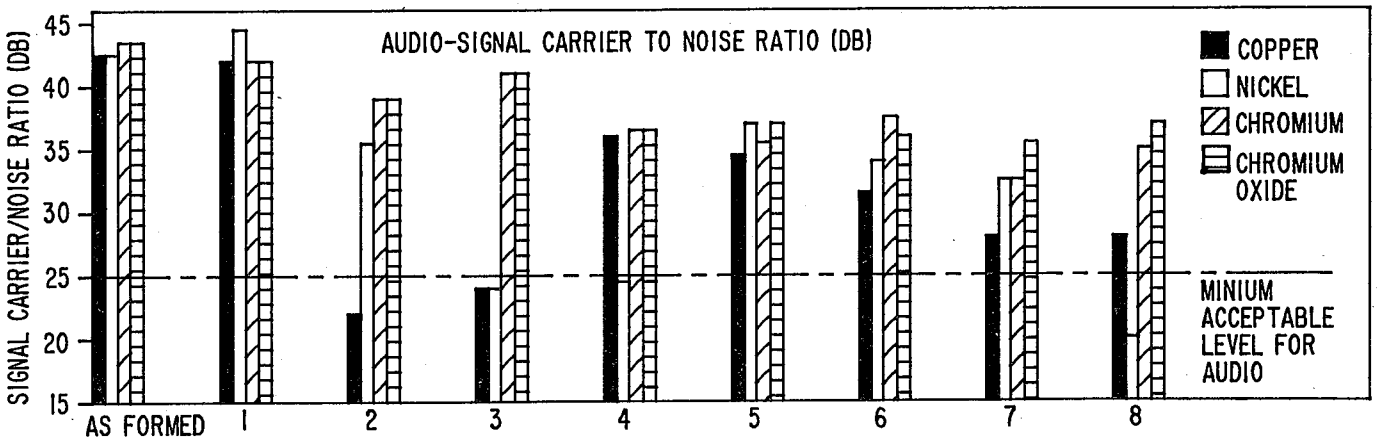
FIG. 4 is a graphic illustration of the audio signal carrier-to-noise ratios in each of the quadrants of the experimental recording substrate.

The results obtained with respect to the carrier-to-noise ratios are graphically represented in FIGS. 3 and 4. The solid bar on the graph relates to the values obtained for the copper quadrant, the plain bar relates to the values obtained for the nickel quadrant, the diagonally hatched bar relates to the values obtained for the chromium quadrant, and the horizontally hatched bar relates to the values obtained for the chromium oxide quadrant.

The surface of the recorded substrate was passivated with potassium dichromate. The substrate was then mounted in electroforming apparatus of the conventional design and a nickel master was formed on the surface of the substrate. The nickel master was then stripped from the substrate.

The substrate was thereafter re-evaluated using the laser beam techniques to determine the carrier-to-noise ratios of the information track in each quadrant. The results of this evaluation are shown in FIGS. 3 and 4 in the column indicated with the figure 1.

The substrate was then repassivated and a second master was formed on the recording substrate. After this master was removed, the substrate was then again evaluated as noted above. The above procedure was repeated until eight masters had been formed on the recording substrate. The results obtained after each replication are graphically represented in FIGS. 3 and 4.

The results obtained as shown graphically in FIGS. 3 and 4 establish that surprisingly the copper portion of the recording substrate exhibited a substantial drop in the carrier-to-noise ratio both in the video and audio areas after the second and third masters were formed on the recording substrate. Even more surprisingly it was found that the copper substrate recovered with regard to the carrier-to-noise ratios after four masters had been pulled from the substrate. However, the carrier-to-noise ratios taken over the entire range indicated a gradual deterioration with regard to the section having the copper surface exposed. The same general pattern of deterioration in the carrier-to-noise ratio was observed in the quadrant which had been treated with the nickel with the exception that the deterioration of the signal initially occurred at a later point in the matrixing process.

More surprisingly, however, the chromium and the chromium oxide treated substrates maintained a high level of performance throughout the entire matrixing process.

EXAMPLE 2

Figure 5:
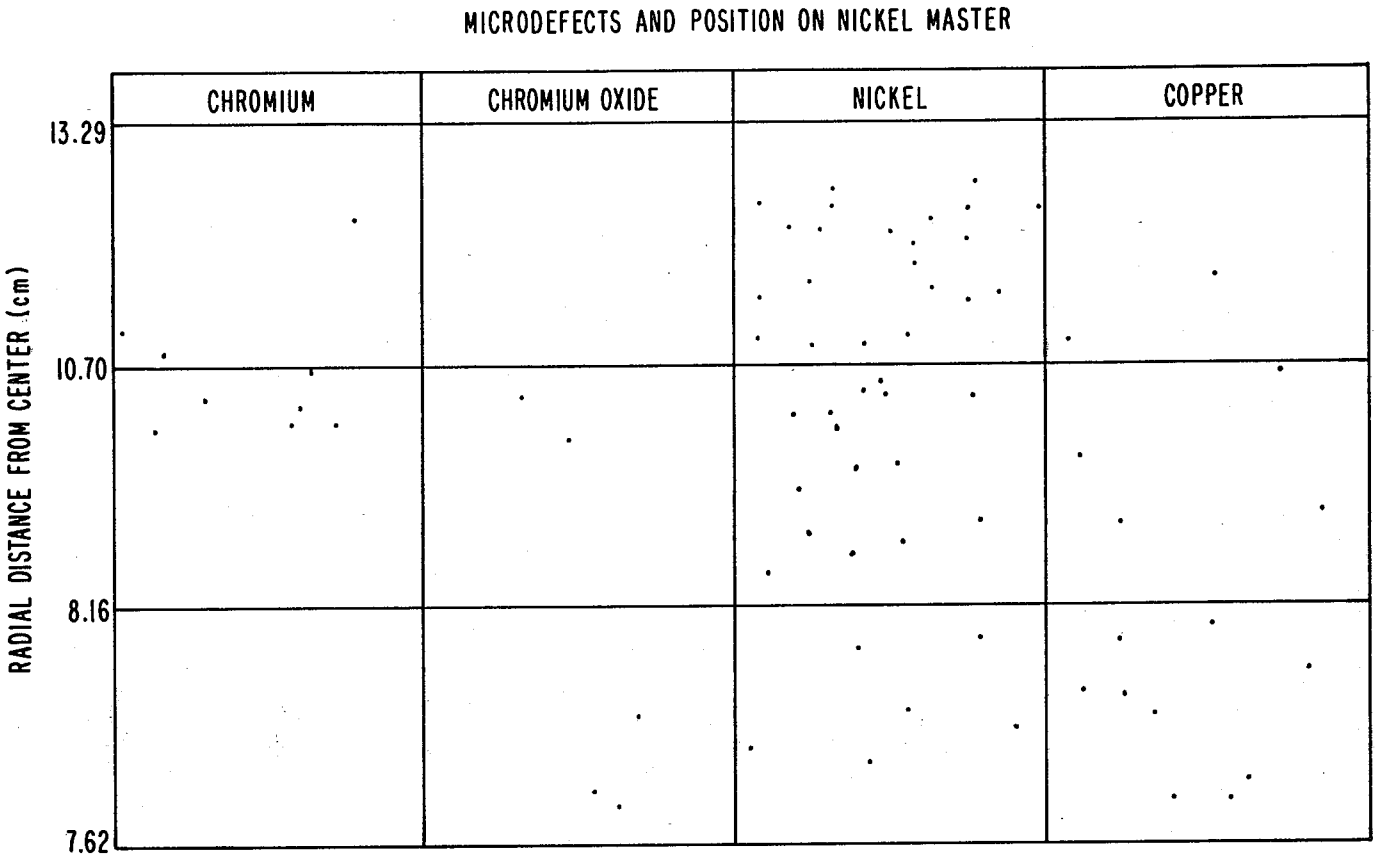
FIG. 5 is a graphic representation of the position and the number of microdefects found on a master formed on the experimental recording substrate.

The sixth master formed on the recording substrate of Example 1 was examined to determined if the particular type of surface treatment, that is, the application of chromium, chromium oxide, nickel, or the untreated copper surface, had any effect on the development of microdefects in the resulting masters formed on the substrates. The microdefects were measured and their position was graphically identified as to both the portion of the particular quadrant in which they occurred, as well as their relative position with respect to the radius of the recording substrate. The results of this evaluation are graphically represented in FIG. 5, which clearly shows that chromium and chromium oxide have a low level of defects, while nickel clearly had the most defects, with copper having an intermediate number.

EXAMPLE 3

The masters compared above were further replicated in standard matrixing procedures to form molds and to thereafter form stampers. The stampers were used to mold capacitance electronic discs from a carbon-filled modified vinyl resin of the type employed in the manufacture of molded discs for capacitive electronic playback. The discs were evaluated in the same manner as the recording substrates and also by playback of the record. It was found that while there was an overall drop in the performance of the molded records with regard to their carrier-to-noise ratios with respect to the substrate, which was expected to be found, that the quadrants of the molded records which were traced back to the chromium or chromium oxide coated recording substrates exhibited superior properties in comparison to both the quadrants traced back to the copper quadrant and the nickel quadrant of the recording substrate.

We claim:

1. In the method for manufacture of a capacitance electronic disc wherein a recording substrate having a metal layer on a surface thereof is recorded in said metal layer with an information track containing video and audio signal information and said recording substrate is thereafter used as a matrix on which to electroform masters for said capacitance electronic discs, the improvement which comprises non-electrolytically applying an about 200 to about 400 angstroms thick continuous adherent conformal layer of a material selected from the group consisting of chromium, chromium oxide and a mixture thereof to the recorded metal surface prior to electroforming a master thereon, thereby reducing the losses in carrier-to-noise ratio of the video and audio signal information as a result of replication of masters on the recording substrate.

2. The method according to claim 1 wherein the metal layer into which the information track recorded is comprised of copper.

3. The method according to claim 1 wherein the surface of the conformal layer is passivated prior to use as a matrix.

4. The method according to claim 3 wherein a plurality of masters are electroformed on the recording substrate and said surface of the conformal layer is passivated prior to each replication.

5. The method according to claim 1 wherein the conformal layer is sputtered on the recorded metal layer.

6. A recording substrate for use in the manufacture of capacitance electronic discs comprising in combination a metal layer having recorded in a surface thereof an information track containing video and audio signal information and an about 200 to 400 angstroms thick non-electrolytically deposited continuous adherent conformal layer of a material selected from the group consisting of chromium, chromium oxide and mixtures thereof formed on the surface of said metal layer.

7. The recording substrate according to claim 6 wherein the metal layer is comprised of copper.

8. The recording substrate according to claim 6 wherein the surface of the conformal layer is passivated.

9. The method according to claim 1 wherein the conformal layer is applied by chemical vapor deposition.

10. The method according to claim 1 wherein the conformal layer is applied by vacuum deposition.

11. In the method for manufacture of a capacitance electronic disc wherein a recording substrate having a copper layer on a surface thereof is recorded in said copper layer with an information track containing video and audio signal information and said recording substrate is thereafter used as a matrix on which to electroform a master for said capacitance electronic disc, the improvement which comprises sputtering an about 200 to about 400 angstroms thick substantial pin hole free adherent conformal layer of a material selected from the group consisting of chromium, chromium oxide and a mixture thereof to the recorded metal surface prior to electroforming a master thereon, thereby reducing the losses in carrier-to-noise ratio of the video and audio signal information as a result of replication of masters on the recording substrate.

* * * * *